US006907698B1

(12) United States Patent
Bond

(10) Patent No.: US 6,907,698 B1
(45) Date of Patent: Jun. 21, 2005

(54) BUILDING SYSTEM AND METHOD OF CONSTRUCTING A MULTI-WALLED STRUCTURE

(76) Inventor: Art Bond, 7400 SW. 4th St., Plantation, FL (US) 33317

( * ) Notice: Subject to any disclaimer, the term of this patent is extended or adjusted under 35 U.S.C. 154(b) by 0 days.

(21) Appl. No.: 10/383,874

(22) Filed: Mar. 7, 2003

(51) Int. Cl.[7] ..... E04F 13/04
(52) U.S. Cl. ..... 52/344; 52/348; 52/354
(58) Field of Search ..... 52/344, 348, 354, 52/7, 29, 36.1, 127.9, 585, 593

(56) References Cited

U.S. PATENT DOCUMENTS 1,577,633 A * 3/1926 Collins ..... 52/250
2,104,875 A * 1/1938 Levy ..... 52/347
2,208,191 A * 7/1940 Kerr ..... 52/344
2,311,951 A * 2/1943 Marshall ..... 52/243
2,969,565 A * 1/1961 Levy ..... 52/126.4
4,494,353 A * 1/1985 Lewis ..... 52/745.19
5,740,643 A * 4/1998 Huntley ..... 52/265
5,740,643 A * 4/1998 Huntley ..... 52/265

* cited by examiner

*Primary Examiner*—Carl D. Friedman
*Assistant Examiner*—Nahid Amiri
(74) *Attorney, Agent, or Firm*—Malloy & Malloy, P.A.

(57) ABSTRACT

A building system including a plurality of supports structured to be vertically disposed in an underlying surface in spaced apart relation from one another, and a plurality of support headers removably disposed on an exposed end of each of the supports. Each support header includes a mounting hub that removably engages the exposed end of the support, and a plurality of engagement elements. A span element is further provided and extends between adjacent supports, each span element including a lock element that matingly engages a corresponding engagement element at the supports so as to removably secure the span element in position. A re-enforcement panel formed of a stiff, open grid configuration is suspended from the span element along with an application panels. The application panel includes a plurality of apertures defined therein to define an open mesh, and a quantity of un-hardened concrete is applied to the application panel in order to substantially cover the application panel, the re-enforcement panel and the supports, thereby defining a wall upon hardening.

21 Claims, 4 Drawing Sheets

BUILDING SYSTEM AND METHOD OF CONSTRUCTING A MULTI-WALLED STRUCTURE

BACKGROUND OF THE INVENTION

1. Field of the Invention

The present invention relates to a building system and method for constructing a multi walled structure, configured to rapidly construct a multi walled structure at almost any location, in a manner which achieves strong, rigid walls, having identifiable strength quotients so as to permit the construction of regulated building structures and the appropriate incorporation thereof into engineering and architectural plans. Moreover, the present building system and method is substantially economical to utilize and incorporates a plurality of reusable, easy to transport and manipulate components, while benefitting from direct concrete application techniques that can be achieve quickly and at low cost in the field.

2. Description of the Related Art

The construction of economic and/or affordable housing and/or other building structures is of paramount importance in virtually every society. Unfortunately, however, of equal importance is the endurance that all building structures are fabricated to certain minimum standards and specifications so as to provide a safe dwelling and/or other facility which can withstand multiple loads and stresses, such as from the elements, acts of nature, normal wear and tear and/or construction stresses.

Although a large number of building structures are still formed from steel and/or wood framing, with the inclusion of cinder blocks and/or molded, poured concrete elements, those traditional manufacturing techniques are often expensive, time consuming and may not be practical in a variety of circumstances and/or at a variety of locations. Indeed, it is recognized that based on the ever increasing cost of construction, many building structures are often formed in what may be considered a pre-fabricated and/or modular type of manner. For example, large wall slabs are often precast at an appropriate, remote location, and those precast slabs are transported to the construction site and appropriately erected, as needed, by various types of machinery. As a result, a relatively strong building structures can be defined in a somewhat rapid and cost effective manner. Regrettably, however even such manufacturing techniques can often prove costly in certain circumstances, and are typically only practical when forming large facilities, wherein heavy duty framing can be installed, and more importantly wherein large heavy duty equipment can have access so as to appropriately position the preformed slabs. As a result, a large segment of the construction field, such as in remote and/or harder to reach locations and/or in connection with smaller facilities and tighter budgets, cannot truly benefit from such pre-fabricated building techniques.

To this end, others in the art have strived to define a variety of different, low cost and economical manners in which to construct building structures. In particular, such techniques seek to deviate from traditional uses of brick and mortar, and/or cinder blocks, etc. so as to define a wall structure, and typically require large amounts of manual labor. One such technique that has recently developed incorporates the application of concrete, such as by a pressurized spray, to a mesh, thereby defining an appropriate wall. While substantial benefits have been derived from such techniques, a large room for improvement still remains. For example, existing construction systems of this type are often difficult and/or complicated to set up, and require extensive and expensive framing materials to be positioned and define portions of the finished wall. Furthermore, such traditional techniques often rely on a flimsy mesh panels to which applied concrete may adhere, but do not truly provide a significant degree of strength and/or re-enforcement to the wall structure, let alone verifiable strength and tolerances figures for one wall as compared to another wall manufactured utilizing the same technique. As a result, it would be highly beneficial to provide a building system and method which can be quickly and easily set up for the appropriate application of concrete and which provides properly defined and uniformly formed walls in an economical and minimally labor intensive manner. Moreover, it would be beneficial for such a technique to provide uniform and readily identifiable re-enforcement and strength characteristics to the wall structure, thereby providing a strong and durable wall with consistent strength characteristics throughout an entire construction. Also, such a system should not be limited to a formation of straight wall segment, but should be able to achieve appropriately positioned corner elements, including interior and exterior corner elements extending in two or more different directions.

SUMMARY OF THE INVENTION

The present invention relates to a building system which is preferably utilized for the construction of a multi walled facility. Specifically, the building system includes at least two, but typically a plurality of supports. The supports are structured to be vertically disposed in an underlying surface in spaced apart relation from one another, and appropriately secured in place.

A support header is further provided. In particular, a support header is structured to be removably disposed on an exposed end of each of the supports that have been previously disposed in the underlying support surface. Preferably, the support headers each include a mounting hub that removably engages the exposed end of the support, such that after construction of a wall section and/or the entire structure, the support header can be substantially easily removed from its engaged relation with the support, and re-used at a subsequent location.

The support headers of the present invention further include at least one, but typically two or more engagement elements. The engagement elements are specifically structured and disposed so as to effectively engage and retain a span element. Specifically, a plurality of span elements are preferably provided, each span element structured to extend between adjacent ones of the supports, and including a corresponding lock element. The lock elements, which are preferably disposed at least at opposite ends of each span element, matingly engage the engagement elements on the corresponding support headers of adjacent supports. Moreover, the lock elements of the span elements and the engagement elements of the support headers preferably removably engage one another, thereby achieving effective and appropriate aligned positioning of the span elements between the adjacent supports, but also allowing for appropriate removability of not only the support headers, but also the span elements for subsequent reuse.

Suspended from each of the span elements is a re-enforcement panel. The re-enforcement panel is generally stiff and includes an at least partially open configuration. Furthermore, an application panel is also provided and is structured to be suspended from the span element in generally confronting relation to the re-enforcement panel. The application panel preferably includes a plurality of apertures defined therein and is structured to receive a quantity of concrete thereon. In particular, a plurality of un-hardened concrete is structured to be applied, either manually and/or through mechanical means to the surface of the application panel in order to substantially cover the application panel, the re-enforcement panel and the supports, and thereby define a wall upon hardening.

Preferably utilizing a preceding system, the present invention further relates to a method for constructing a multi walled structure. In a preferred embodiment, the method comprises the opening and/or defining of at least three holes in an underlying surface and the securement of a rigid support in a vertical orientation within each of those holes. A support header can then be placed on the exposed end of each of the rigid supports, and a span element is appropriately positioned to span adjacent ones of the rigid supports, engaging the correspondingly positioned support headers. A header cap is then positioned in an engaging relation with the adjacent span elements, as well as the support header, which they both correspondingly engage, thereby effectively maintaining a secure positioning and alignment of the span elements relative to one another.

With the span element in place, at least one application panel is suspended from each of the span elements, and a pair of re-enforcement panels are further suspended from each of the span elements in sandwiching relation to the application panel. With all of the panels in place, a quantity of concrete is then applied to at least the application panels, the concrete being applied from the underlying surface up to the span element so as to effectively cover the application panels, the re-enforcement panels and the rigid support. The concrete is then allowed to harden so as to define a wall, and finally, the header caps, span elements and support headers are effectively removed from the formed wall for subsequent re-use as needed.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
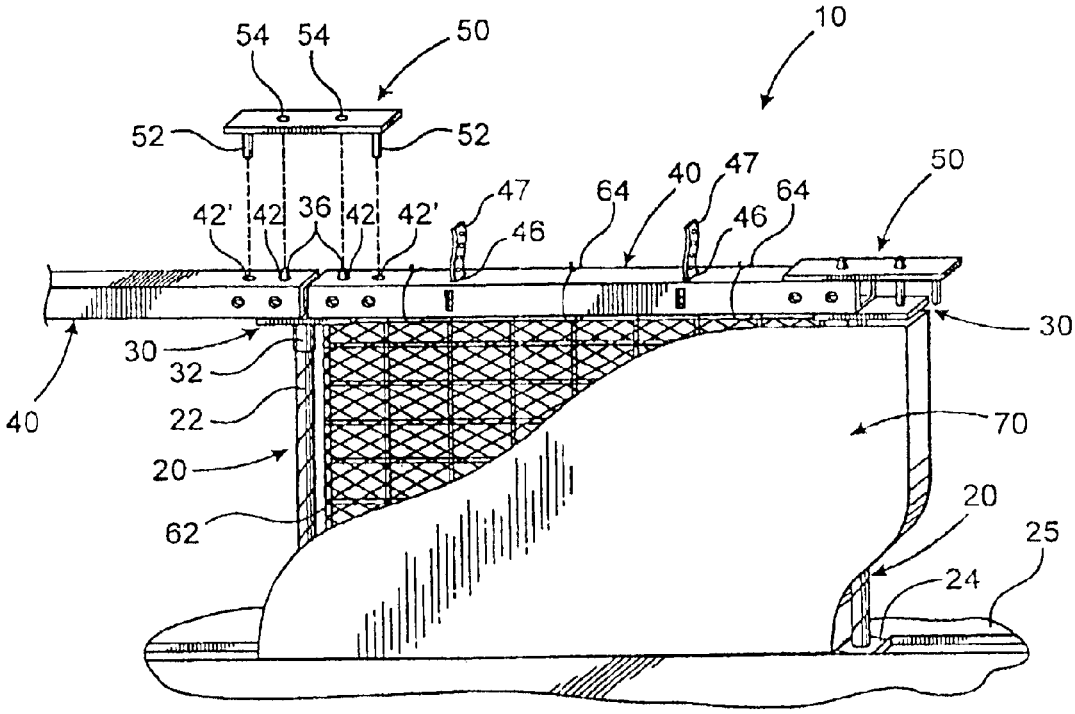
FIG. 1 is a partial perspective illustration of a wall surface fabrication utilizing the building system and method of the present invention.
Figure 5:
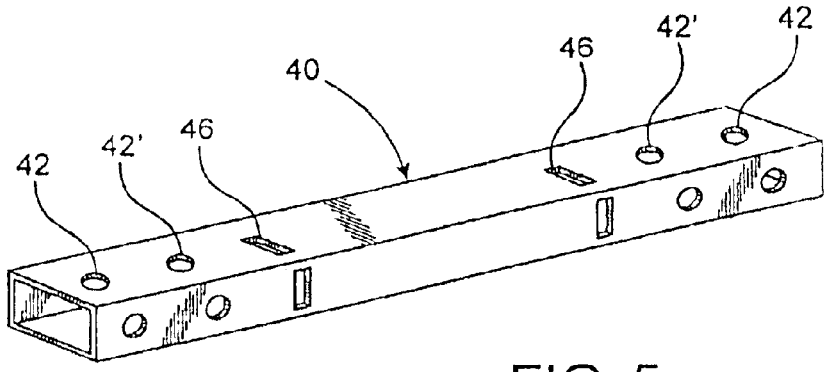
FIG. 5 is an isolated perspective view of one embodiment of the span element utilized within the building system and method of the present invention.

Shown throughout the Figures, the present invention is directed towards a building system, generally indicated as 10. In particular, the building system 10 is structured to be substantially rapid and easy to implement in a cost effective manner so as to form a preferably multi walled structure which has substantial strength and durability despite its low cost and rapid deployment. Furthermore, the present building system 10 is specially structured to facilitate rapid and easy construction in a variety of locations including locations wherein heavy equipment cannot necessarily be utilized.

As illustrated in the Figures, the present building system 10 includes at least two, but often a plurality of supports 20. The supports 20 are preferably substantially rigid, and may be formed from any variety of strong, durable rigid materials, but preferably iron or steel. Moreover, the thickness and/or dimensions of the supports may correspondingly vary, however, a standard ¾ inch to 1 inch diameter may be sufficient in a majority of cases, and to this end, and in order to maximize the economics of the overall construction, standard and/or conventionally available materials, such as re-bar type rods are preferably utilized.

The supports 20 are structured to be vertically disposed into an underlying surface 25 in spaced apart relation from one another, and are preferably effectively and substantially permanently secured into the underlying support surface 25 in a vertical, upstanding orientation. To this end, the overall height of these supports 20 may vary depending upon the desired height of the wall section to be formed above the underlying surface 25. Furthermore, the underlying surface 25 may be dirt or soil, or may be concrete or any other material which may make a foundation or even an underlying base for a subsequent foundation of a building structure. As a result, it may be preferred that a hole 24 be made in the underlying surface 25 into which the support 20 can be inserted, and then subsequently secured, such as by pouring concrete into the hole 24 and thereby fixing the support 20 in place.

Looking further to the number of supports 20 which may be utilized, for purposes of clarity when reference is made herein to the present invention, a wall section may be defined as the section between a pair of spaced apart, yet adjacent supports 20. Nevertheless, it is recognized that more than two supports may be utilized to define a single wall section of larger or smaller size, and the beginning and/or ending of a wall section need not necessarily be determined by a change in direction of that wall section. As indicated, however, for purposes of clarity a wall section may be defined between an adjacent pair of supports 20.

Figure 2:
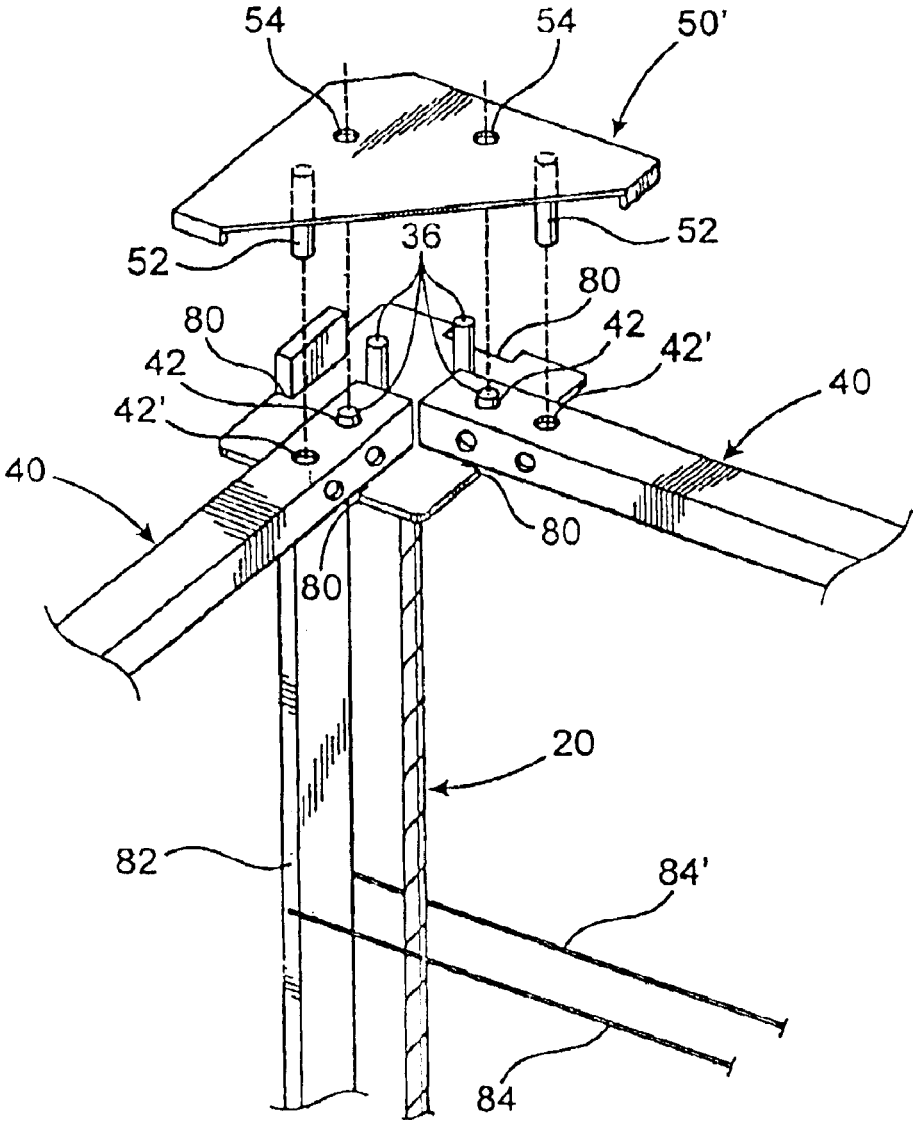
FIG. 2 is an exploded, partial perspective view of a corner construction utilizing the building system and method of the present invention.
Figure 3:
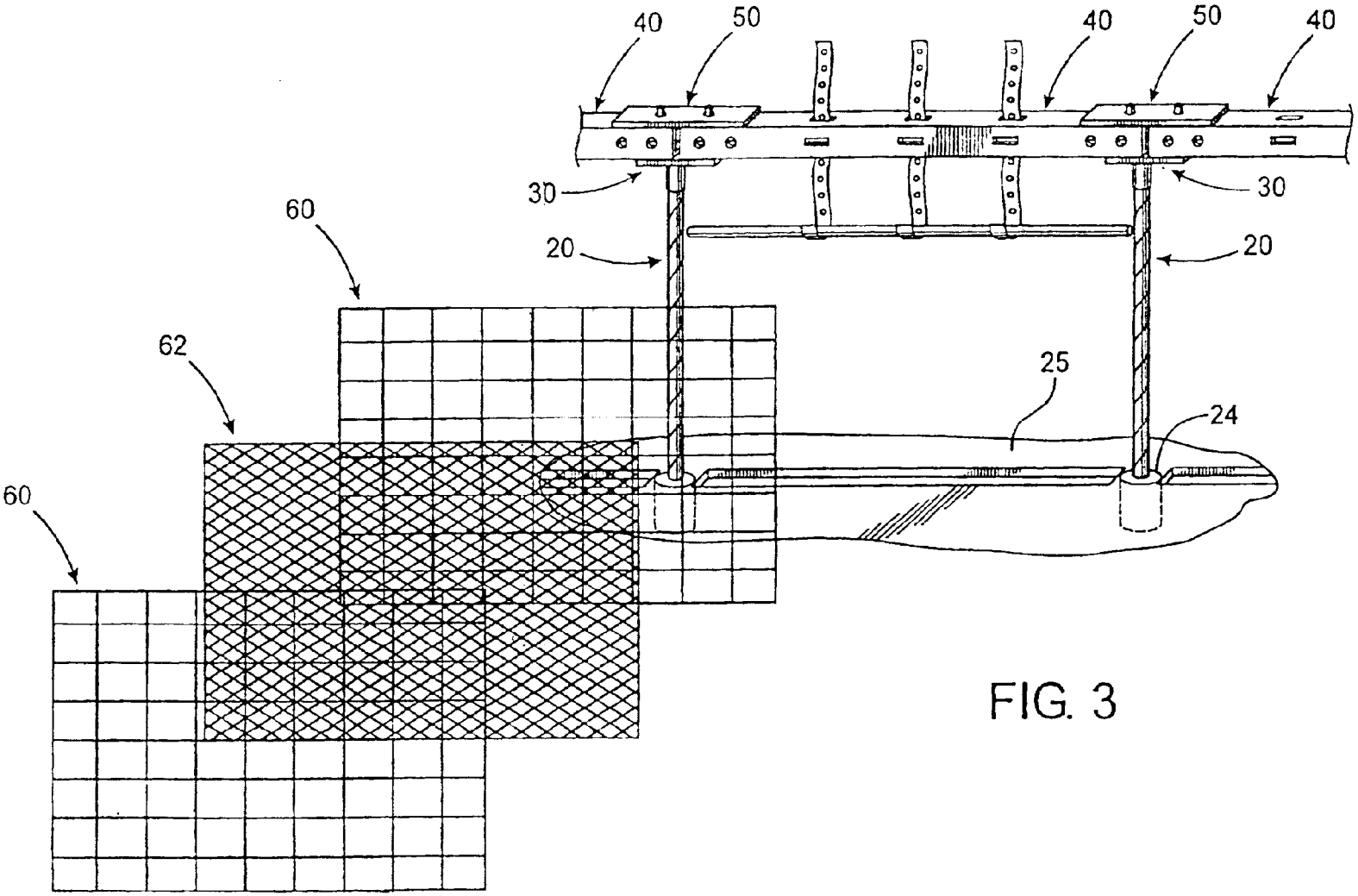
FIG. 3 is an exploded perspective illustration of the various material panels preferably utilized in connection with the present building system and method.
Figure 4:
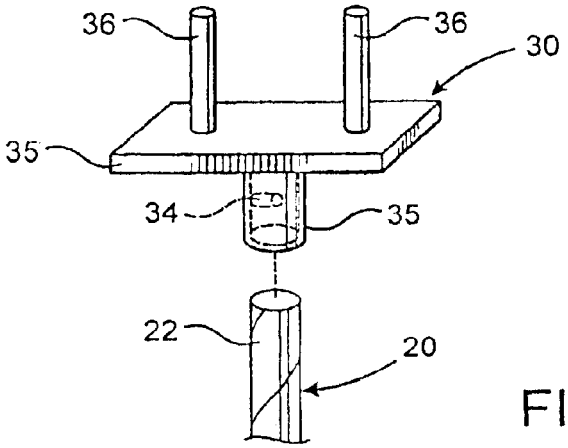
FIG. 4 is an isolated view of one embodiment of the support header utilized within the building system and method of the present invention.
Figure 6:
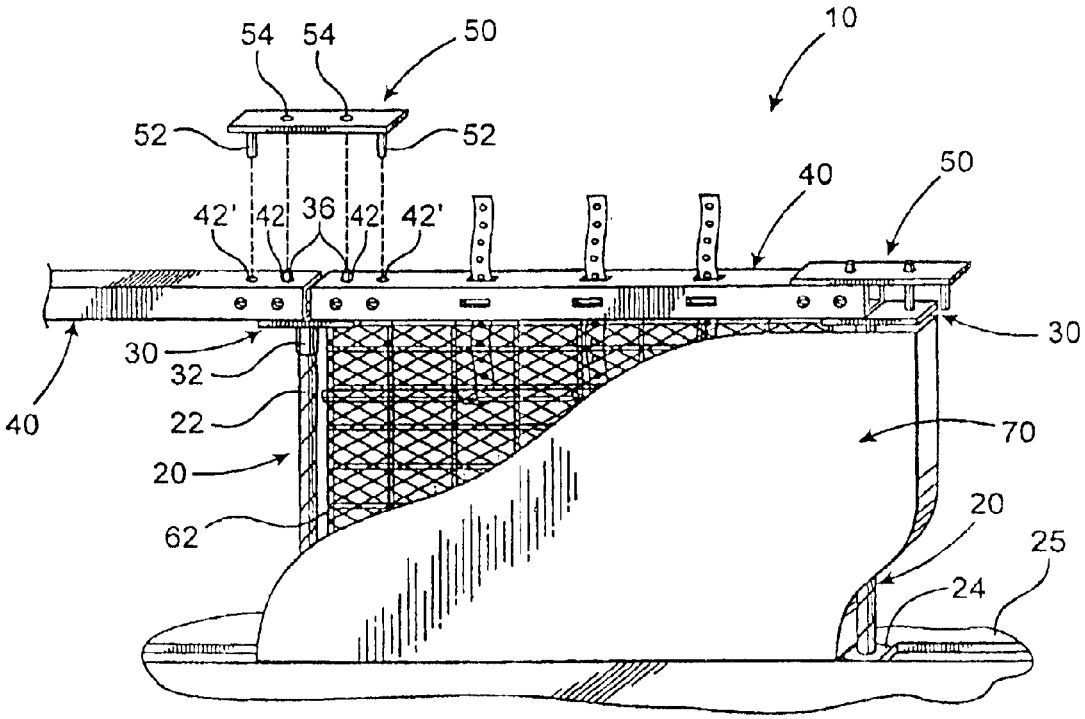
FIG. 6 is a partial perspective illustration of a wall surface fabrication utilizing the building system and method of the present invention wherein the roof straps suspend thepanels in place.

The building system 10 of the present invention further includes at least one, but typically a plurality of support headers 30, 30'. In particular, the support headers 30, 30' are structured to be removably disposed on an exposed end 22 of each of the supports 20. Furthermore, as will be described in greater detail subsequently, the support headers may include a standard linear support header 30, as illustrated in FIG. 1 and/or a corner support header 30' as illustrated in FIG. 2. Looking in further detail, however, to the positioning of the support headers 30, 30' on the supports, each preferably includes a mounting hub 32 that removably engages the exposed end 22 of the support 20. In this regard, the mounting hub 32 may include any of a variety of configurations and/or structures which provide for effective securement and positioning of the support header 30, 30' on the exposed end 22 of the support 20. In the preferred embodiment, the securement to the support 20 is removable and moreover, in the illustrated embodiment the mounting hub 32 preferably includes a socket into which the exposed end 22 of the support 20 may be effectively introduced, such as in an axial manner. As a result, the support header 30, 30' can be effectively fitted over the end of the support 20, with the support 20 effectively secured in the underlying surface 25, in order to achieve an appropriate vertical structure that preferably stands on its own.

As indicated, the support header 30, 30' is preferably removable subsequent to formation of the wall, as will be described. As such, it is preferred that the mount hub 32, and in particular the socket configuration include a rounded exterior surface. In this manner, even when encased in concrete, a twisting of the support header 30, 30', such as with the aid of some force or an impact, can effectively disengage the mount hub 32 from an embedded orientation within the concrete of the formed wall section, providing for removal from the support 20. In such an embodiment, the resultant hole may be filed with small quantities of concrete in order to seal the opening and further define the wall section. Additionally, preferably disposed within the socket of the mounting hub 32 is a spacer element 34. In particular, the spacer element 34 is preferably secured to the support header 30, 30' and helps to achieve some spacing of the support header 30, 30' above the end of the support 20.

In addition to the mounting hub 32, each support header 30, 30' also preferably includes one or more engagement elements 36. In particular, in the preferred embodiment of the support headers 30, 30' may include a frame member 35 that is preferably positioned atop the mounting hub 32 so as to generally define a platform. Disposed preferably at that vertical platform 35 are one or more of the engagement elements 36. Specifically, the engagement elements 36 are each structured to effectively and securely engage a span element 40 further included as part of the present building system 10. Preferably, the present building system 10 includes one or more span elements 40. These span elements 40 are preferably formed from a substantially strong, rigid material construction, and may include a hollow and/or solid tubular configuration. Furthermore, the span elements 40 are preferably structured to extend from one support 20 to an adjacent support. In this regard, it is recognized that a single span element 40 may extend between a plurality of supports 20, however for purposes of clarity and explanation a description relative to the spanning of only a pair of spaced apart supports 20 will be described. Furthermore, in the preferred, illustrated embodiment, the span element may include a rectangular cross section such that changing the orientation of the span element 40 may change a thickness of the wall to be produced in the manner described. For example, the span element may have a 3 inch by 4 inch dimension so as to allow for a 3 inch or 4 inch wall thickness guide to be defined.

In order to effectively secure and position the span elements 40 in spanning relation between adjacent supports 20, each span element preferably includes at least one lock element 42, and typically at least one lock element 42 disposed at opposite ends thereof. These lock elements 42 are preferably, but not necessarily, in the form of apertures and are structured to engage the engagement elements 36 on the support headers 30, 30' in order to achieve effective interlocking, yet removable engagement therebetween. Looking to the preferred, illustrated embodiments of the present invention, the engagement elements 36 of the support headers 30, 30' preferably include rigid shaft segments which extend upwardly from the platform 35 of the support headers 30, 30'. Correspondingly, the lock elements 42 of the span elements 40 are preferably defined by correspondingly disposed apertures which are structured to be fitted over the engagement elements 36 so as to achieve effective interlocking engagement therebetween. Furthermore, in the illustrated embodiment, the apertures may be defined in all faces of the span element 40 so as to allow for alternate positioning of the span element. It is also recognized that although such a configuration of the engagement element and lock element is preferred, alternate configurations may also be equivalently utilized to achieve interlocking, including the inclusion of a rigid shaft segment depending from the span element 40 into a corresponding aperture and/or recess associated with the support header 30, 30'. Nevertheless, viewing the preferred, illustrated embodiment preferably an aperture 42 is defined at each end of the span element 40 to engage one of the engagement elements 36 on each corresponding support header 30, 30' thereby effectively providing for interlocking therebetween. Furthermore, although it is recognized that a pair of engagement elements 36 may be provided to engage each end of a single span element 40, thereby prevent twisting and/or pivoting therebetween, in the illustrated embodiment and as will be described subsequently, only a single engagement element 36 and lock element 42 need engage one another to provide for effective securement. As a result of this configuration, and as illustrated in FIG. 1, the span elements 40 may be effectively disposed in an end relation to one another, wherein a pair of span elements 40 engage a single support header 30 in a linear and/or slightly angled configuration.

Turning FIG. 2, however, and as previously recited, it is also understood that the support header 30 may further include a corner support header 30'. In such an embodiment, the engagement elements 36 may be slightly off set from one another and may be positioned so as to allow span elements 40 to extend from the corner support header 30' in different directions from one another, and in many embodiments at generally a 90 degree angle relative to one another. In this regard, although it is preferred that at least two engagement elements 36 be provided on the corner support header 30' as with the other embodiments of the support header 30, it is also noted that in such an embodiment a larger number of engagement elements, such as three or four engagement elements may be effectively provided at the corner support header 30'. As such, the span elements 40 may extend away from the corner support header 30' in virtually any direction, including making a four corner type wall section, and/or merely making a 90 degree wall corner that may go in any direction.

Utilizing the preferred structure of the engagement elements 36 and lock elements 42 between the support headers 30, 30' and the span elements 40, it is recognized adjacent span elements 40 secured at the same support header 30, 30' may be pivoted at virtually any angle relative to one another. While the securement of the opposite ends of the span element 40 at the support header 30, 30' on an adjacent support 20 will effectively serve to define a relative angle and/or orientation of adjacent span elements 40 to one another, in the preferred, illustrated embodiments a corresponding header cap 50, 50' is preferably provided for each support header 30, 30'. In particular, the header cap 50, 50' is preferably structured to engage each of the two or more adjacently disposed span elements 40 at the support header 30, 30', as well as to effectively engage the support header 30, 30' itself. In that manner the relative orientation of the adjacent span elements 40 can be effectively secured and a substantial degree of stability can be maintained while the construction process is completed. Looking to FIG. 1, the header cap 50 may include a linear header cap such as in the form of adjacent, and end to end wall section, or as illustrated in FIG. 2 may include a corner header cap 50' which can appropriately secure and maintain the adjacent span elements 40 in a desired angled orientation relative to one another. Although a variety of different modes of engagement may be effectively achieved between the header cap 50, 50' and the span elements 40 and support headers 30, 30', with regard to the preferred, illustrated embodiments of the engagement elements 36 and lock elements 42, it is preferred that the header caps 50, 50' be configured with at least one but preferably a pair of apertures 54 as well as a pair of downwardly depending shaft segments 52. Specifically, the apertures 54 on the header cap 50, 50' are preferably structured to receive the distal ends of the engagement elements 36 of the support header 30, 30' subsequent to their passage through the lock element 42 of the span elements 40. Additionally, however, each of the span elements 40 preferably also includes an additional pair of apertures 42' spaced apart from the lock elements 42. This additional set of apertures 42' is preferably configured so as to receive the downwardly depending shaft segments 52 of the header caps 50, 50' therethrough. As a result, an effective and sturdy securement of adjacent span elements 40 relative to one another can be appropriately achieved in a substantially quick and rapid manner, once the concrete footer at the base of each support 20 has hardened.

Preferably suspended from each of the span elements 40 are one or more panels. In particular, in the preferred, illustrated embodiments one or more re-enforcement panel (s) 60 are preferably secured in a suspended orientation beneath the span element 40. Each re-enforcement panel 60 preferably includes an at least partially open configuration and is formed of a strong, generally stiff material. For example, an open mesh or grid of rigid metal strands or fibers may be appropriate, and in a preferred embodiment 6×6, no. 10 road grade mesh may be preferred. Of course, it is recognized that the re-enforcement panel 60 may be formed of a variety of materials, however, a metal is preferred for strength and/or durability, and a standard gage is preferred so that readily identifiable strength characteristics can be associated to its re-enforcement of the wall section. Moreover, when multiple re-enforcement panels 60 are used, they are preferably offset from one another such that the openings defined therein are not necessarily lined up exactly. Furthermore, each re-enforcement panel 60, which as indicated is suspended from the span elements 40, may be secured in any of a variety of fashions including hooks, latches, magnets, clips, etc. In the illustrated embodiments a roofing strap or a series of wire loops 64 are provided for quick and easy looped fastening about the span element 40.

Further suspended beneath each span element 40 is preferably at least one application panel 62. Specifically, the application panel 62 preferably includes a plurality of apertures defined therein, and may also be formed of a mesh type configuration, such as from an expanded metal that may be smooth or contoured. In this regard, it may be preferred that the construction of the application panel 62 be such that the apertures defined therein be somewhat closely spaced relative to one another. In particular, the present invention further comprises a quantity of unhardened concrete 70 which is to be applied at the application panels 62 in order to ultimately define the wall. As a result, by including an open configuration with preferably somewhat small, tightly spaced apertures, effective application of the concrete can be achieved. Further, a re-enforcement panel 60 may preferably be disposed on opposite sides of the application panel 62, and the quantity of concrete 70 is preferably applied from both sides in order to define a wall segment.

Although manual application of the unhardened concrete may be effectively achieved, in the preferred embodiment a pressurized application of unhardened concrete in a spray type fashion is preferred. Based upon a structure and configuration of the application panels 62 and the re-enforcement panel 60, however, quantities of concrete can pass therethrough, yet still substantially adhere, at least to the application panels 62, so as to give thickness to the wall segment and provide for a substantially solid layer of concrete 70 throughout. As mentioned, once the concrete 70 has been applied from one side, if necessary, a further quantity of concrete can be applied from an opposite side in a similar fashion so as to appropriately define the wall segment. Moreover, if desired, once the concrete is applied, smoothing can be achieved by a user, such as using a trowel or similar type of smoothing process. Nevertheless, in the preferred embodiment the unhardened concrete is preferably applied to extend from the underlying surface 25 up to at least a top of the panels 60, 62 and/or up to the span element 40. It is, however, preferred that the span element 40 not be completely covered in order to permit its subsequent removability.

In order to achieve a substantial degree of uniformity as to the thickness of the wall segment that is defined utilizing the building system 10 and method of the present invention, each corner support header 30' preferably includes one or a plurality of guide segments 80 defined therein. In particular, the guide segments may include one or a series of single or multi-sized notches. Although a single guide segment 80 may be sufficient, in the preferred embodiment, the corner support header 30' preferably includes a guide segment 80 on all faces thereof so as to facilitate usage of a specific corner support header 30' at generally any corner of a building structure to be defined. The guide segments 80 are structured to engage and maintain a vertical guide locator 82 appropriately vertically aligned. The vertical guide locator 82 preferably includes a substantially rigid segment which in the illustrated embodiments may include a section of the span element 40 and/or a piece of lumber, such as a standard 2×4. With the vertical guide locator 82 appropriately secured in the desired vertical orientation, one or more guide elements 84, 84' are preferably extended therefrom to a correspondingly disposed vertical guide locator 82 on an adjacent support header 30, 30'. In particular, the guide element 84, 84' may include a long strand of wire, string or other material and extends from a vertical face of the vertical guide locator 82 to a corresponding vertical face of the vertical guide locator on an adjacent support header 30, 30'. In the case of the inclusion of a pair of guide elements 84, 84', they may extend from opposite sides of the vertical guide locator 82 such that the width of the vertical guide locator 82 will generally define a width of the wall structure that is ultimately formed. Of course, it is recognized that the guide element 84, 84' may include a single element wrapped around one or more of the vertical guide locators 82 or may include separate segments. Further, the guide elements 84, 84' may be directly adjacent the vertical side faces of the vertical guide locator 82 or may be spaced therefrom, such as through the use of a nail, clip, screw, etc., which provide a defined spacing from those side faces. With the guide element 84, 84' in place, an appropriate width of the wall structure can be defined subsequent to application of the unhardened concrete, with the guide elements 84, 84' serving as a markers for the desired thickness of the wall structure, indicating how much of the concrete should be applied and/or how much of the concrete should be removed during a smoothing process. Indeed, it is also noted that while a single guide element 84 or 84' may be disposed on each side of the wall section, a series of vertically spaced guide elements 84, 84' may also be provided so as to provide an even greater degree of uniformity relative to the thickness of the finished wall section along its entire height.

In addition to the proceeding structural features, it is also recognized that a variety of construction features which may be beneficial for the formation of the building structure may also be effectively integrated into the building system 10 of the present invention. For example, one or more roofing straps 47 may be effectively secured, such as to one or more of the panels 60, 62, thereby appropriately being embedded in the hardened concrete. In such an embodiment, the roofing straps 47 may merely protrude out from beside the span elements 40, and/or one or more slots 46 may be defined in the span element 40 for appropriate passage of the roofing straps 47 therethrough, if necessary. Additionally, as illustrated in FIG. 1, in addition to or instead of the wire loops 64, the one or more panels may be suspended from the span elements using the roofing straps 47. Specifically, a series of spaced, and often precisely spaced and sized slots 46 may be defined in the span element 40, a corresponding roofing strap 47 being extended there through. With the strap 47 preferably suspended in place at a uniform height, such as by passing a segment through one of its nail holes and allowing it to hang in place, an end of the strap 47 can include or be formed into a hook onto which the panels are suspended at a uniform height. Furthermore, in this and other embodiment a horizontal segment of re-bar type re-enforcement can be suspended with the panels to provide added re-enforcement.

Furthermore, one or more forms and/or molds may also be suspended from the span elements 40 so as to define windows, doors and/or other openings. In particular, a panel 60, 62 may be cut, and a removable form appropriately suspended and/or disposed at a desired location for a window opening as defined by the cut. As such, once the concrete has effectively hardened around the form, the form must merely be removed and the window opening or other opening remains. Of course, it is also understood that an appropriate form may be positioned merely over a panel 60, 62, such as using the same structured used to define the span elements 40, and once the form is removed after at least partial hardening of the concrete, cutting of the panels in order to fully define the opening can be achieved.

Also, although the present structure and configuration of the various components of the present building system 10 are such that removability of the header caps 50, 50', span elements 40, and support headers 30, 30' should be relatively easily achieved after at least partial and preferably complete hardening of the concrete to define the wall section, in some instances a lubricant type material and/or other material which prevents the concrete from hardening and/or excessively sticking thereto may also be applied to those removable elements.

From the proceeding it can also be seen that the present building system 10 is especially beneficial for use during the employment of a method of constructing a multi walled structure. Specifically, the method may include the opening of at least three, but generally a large number of holes in an underlying surface 25, and then vertically securing a rigid support 20 in each of the holes. A support header 30, 30' having at least two engagement elements 36 is then disposed on the exposed end 22 of each of the rigid supports 20 and a span element 40 is suspended between the adjacent support 20 at the support headers 30, 30'. With the span element(s) 40 in place, a header cap 50, 50' is preferably disposed thereon so as to effectively secure adjacent span elements 40 in an appropriately aligned configuration relative to one another, and a plurality of panels, including preferably a re-enforcement panel 60 and an application panel 62 are suspended from the span element 40. Finally, a quantity of concrete is applied to the panels and allowed to hardened, after which the header caps, span elements and support headers may be removed for re-use as needed.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A building system comprising:

a) at least two supports, said supports structured to be vertically disposed in an underlying surface in spaced apart relation from one another;

b) a support header structured to be removably disposed on an exposed end of each of said supports;

c) said support header including a mounting hub structured to removably engage said exposed end of said support;

d) said support header further including an engagement element;

e) a span element, said span element structured to extend between adjacent ones of said supports;

f) said span element further including a lock element structured to matingly engage said engagement element on said adjacent ones of said supports so as to removably secure said span element between said adjacent ones of said supports;

g) a re-enforcement panel structured to be suspended from said span element, said re-enforcement panel being generally stiff and including an at least partially open configuration;

h) an application panel structured to be suspended from said span element in generally confronting relation to said re-enforcement panel, said application panel including a plurality of apertures defined therein; and i) a quantity of concrete structured to be applied to said application panel to substantially cover said application panel, said re-enforcement panel and said supports, and thereby define a wall upon hardening.

2. A building system as recited in claim 1 wherein each of said supports includes a generally rigid, shaft.

3. A building system as recited in claim 1 further comprising a concrete footer structured to secure each of said supports in a vertical orientation within the underlying surface.

4. A building system as recited in claim 1 wherein said mounting hub of said support header comprises a socket structured to receive said exposed end of a corresponding one of said supports therein.

5. A building system as recited in claim 4 wherein said mounting hub further comprises a spacer element disposed in said socket and structured to elevate said engagement element above said exposed end of a corresponding one of said supports.

6. A building system as recited in claim 4 wherein said socket comprises an at least partially rounded exterior configuration structured to facilitate separation from said concrete after hardening thereof.

7. A building system as recited in claim 1 further comprising a pair of said re-enforcement panels, each of said re-enforcement panels suspended from said span element on opposite sides of said application panel.

8. A building system as recited in claim 1 wherein said support header comprises a pair of said engagement elements, each of said engagement elements structured to engage an adjacent one of said span elements.

9. A building system as recited in claim 8 further comprising a header cap, said header cap structured to engage at least one of said engagement elements and each of said adjacent ones of said span elements so as to generally maintain said span elements in a correspondingly aligned relation to one another.

10. A building system as recited in claim 8 wherein said engagement element comprises a rigid shaft segment and said lock element comprises an aperture structured to receive said rigid shaft segment therethrough.

11. A building system as recited in claim 10 wherein said lock element disposed at one end of said span element comprises a pair of apertures, one of said apertures structured to receive said rigid shaft segment of said engagement element.

12. A building system as recited in claim 11 further comprising a header cap, said header cap structured to engage at least one of said engagement elements and each of said adjacent ones of said span elements so as to generally maintain said span elements in a correspondingly aligned relation to one another.

13. A building system as recited in claim 12 wherein said header cap comprises a pair of apertures and a pair of downwardly depending shaft segments, said apertures structured to receive said shaft segments of said support header which extend through said apertures in adjacent ones of said span elements, and said downwardly depending shaft segments structured to extend through said other aperture in each of said adjacent span elements.

14. A building system as recited in claim 1 wherein said support header further comprises a corner support header.

15. A building system as recited in claim 14 wherein said corner support header comprises two of said engagement elements structured to engage adjacent ones of said span elements which extend in different directions from one another.

16. A building system as recited in claim 15 wherein said corner support header comprises four of said engagement elements structured to engage at least two adjacent ones of said span elements which extend in different directions from one another.

17. A building system as recited in claim 15 wherein said corner support header comprises a guide segment, said guide segment structured to engage a vertical guide locator and to maintain said vertical guide locator in a vertically aligned orientation.

18. A building system as recited in claim 17 further comprising adjacent corner support headers, a guide element structured to extend between said vertical guide locators disposed at said adjacent corner support headers and structured to define an exterior surface of said wall formed by said concrete.

19. A building system as recited in claim 18 further comprising a pair of guide elements extending from opposite vertical faces of said vertical guide locator to corresponding vertical faces of said vertical guide locator on said adjacent corner support headers so as to define a width of said wall.

20. A building system as recited in claim 17 wherein at least one of said adjacent corner support headers comprises at least two guide segments.

21. A building system as recited in claim 17 wherein at least one of said adjacent corner support headers comprises at least four guide segments.

* * * * *